United States Patent [19]

Manaresi

[11] 4,077,551

[45] Mar. 7, 1978

[54] CONTAINER WITH BOTTOM SEALING DISK WHICH BECOMES A DEFORMABLE MEMBER ON DISCHARGE

[76] Inventor: Adriana Manaresi, Via delle Porte Nuove 12, Florence, Italy

[21] Appl. No.: 658,048

[22] Filed: Feb. 13, 1976

[51] Int. Cl.[2] ..... B65D 25/40

[52] U.S. Cl. ..... 222/494; 206/221; 222/498; 222/541

[58] Field of Search ..... 222/137, 145, 394, 491, 222/494, 498, 80, 541; 128/218 R, 218 M, 218 NV; 206/221

[56] References Cited

U.S. PATENT DOCUMENTS

| | | | |
|---|---|---|---|
| 2,607,341 | 8/1952 | Brown | 128/218 R |
| 3,373,743 | 3/1968 | Saffir | 128/218 NV |
| 3,967,759 | 7/1976 | Baldwin et al. | 222/145 |

FOREIGN PATENT DOCUMENTS

| | | | |
|---|---|---|---|
| 717,329 | 10/1966 | Italy | 222/80 |

*Primary Examiner*—Robert B. Reeves
*Assistant Examiner*—David A. Scherbel
*Attorney, Agent, or Firm*—Haseltine, Lake & Waters

[57] ABSTRACT

This invention relates to a capsule which comprises a glass-shaped body with a funnel-shaped bottom having a central hollow extension which can be cut off, an upper closure baffle which can be pierced in order to introduce a diluent, a sealing disc comparatively flexible which is inserted into the glass-shaped body until the latter rests along a continuous supporting edge to ensure the seal by means of a slight forcing; and, below said supporting edge, projections contacting the disc and deforming it when this is thrusted beyond the supporting edge under an inner pressure allowing in this manner the liquid to flow out. This capsule is designed for preparing beverages.

4 Claims, 8 Drawing Figures

CONTAINER WITH BOTTOM SEALING DISK WHICH BECOMES A DEFORMABLE MEMBER ON DISCHARGE

BACKGROUND OF THE INVENTION

The invention relates to a system for confectioning — by means of capsules — unitary doses of concentrated products for the extemporary preparation of beverages by means of a pressure fluid, especially a diluent (mostly hot or cold water, gassed water or the like) which is introduced into the capsule and must be delivered from said capsule into the receptacle — glass, cup or the like — by means of which the beverage is to be administered.

One object of the invention is that the capsule has a hermetic seal during the preservation before use, even when the capsule contains a liquid dose (for instance, a syrup, a concentrated infusion or the like).

Another object of the invention is that, when the delivery takes place, the mixture, which is formed in the capsule combining the unitary dose and the extemporarily supplied liquid, comes out of the capsule into the administering receptacle, undergoing a filtering effect or at least a pressure drop effect owing to the presence of resistances along the out-flow path; this is required in order to avoid an irregular and violent delivery owing to the fluid pressure which must be attained in the capsule interior to obtain the delivery, said pressure depending upon the supply pressure of the diluent or of a gas delivered simultaneously or subsequently to the diluent. A further object of the invention is that the capsule must ensure the possibility of piercing a sealing baffle to obtain the introduction of the diluent. Still a further object of the invention is that, when the delivery takes place, the contact of the mixture in the capsule with elements of the apparatus used for preparing the beverage is avoided; it is in fact necessary that the same apparatus may be able to deliver from capsules with different contents from one another, without the taste of a previously prepared drink affecting the taste of a subsequently prepared beverage. The capsule may be used in the apparatus according U.S. Pat. No. 3,298,527 to STASSE.

BRIEF SUMMARY OF THE INVENTION

For the above purposes, and bearing also in mind the requirement of a low cost, a capsule according to the invention is of the kind comprising a glass-shaped body with a tapered bottom and with a central terminal hollow extension capable of being cut off, as well as a pierceable upper closure baffle for the introduction of the diluent; the capsule characteristically further includes a relatively flexible sealing disc which is inserted into the glass-shaped body to rest along a continuous supporting edge thus ensuring the seal with a light forcing between the periphery of the disc and the side wall of the capsule; moreover, internal extensions, designed to contact the sealing disc when the latter is urged by an internal pressure beyond said supporting edge, are provided beneath said supporting edge, in such a manner that said disc resting at spaced points and always subjected to the inner pressure, is deformed along the periphery causing the separation of zones of the disc peripheral edge from the lateral wall of the glass-shaped body, to allow in this manner the outflow of the liquid from the glass-shaped body interior through the cut-off hollow extension forming a delivery opening.

DESCRIPTION OF THE DRAWINGS

The invention will be better understood following the description and the accompanying drawing, which illustrates an embodiment not restricting the same invention. In the drawing.

DESCRIPTION OF THE PREFERRED EMBODIMENTS

Figure 1:
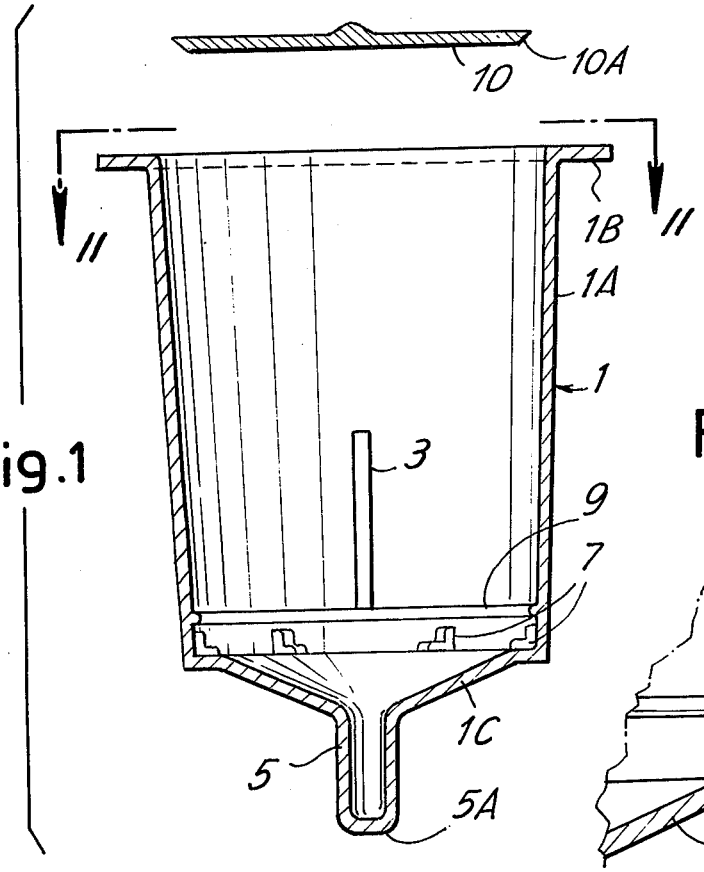
FIG. 1 is an axial section, i.e. diametral section, of the glass-shaped body and the sealing disc separately, the section being taken along line I—I of FIG. 2.
Figure 3:
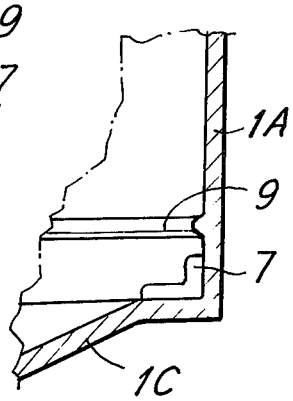
FIG. 3 illustrates an enlarged detail of FIG. 1.
Figure 2:
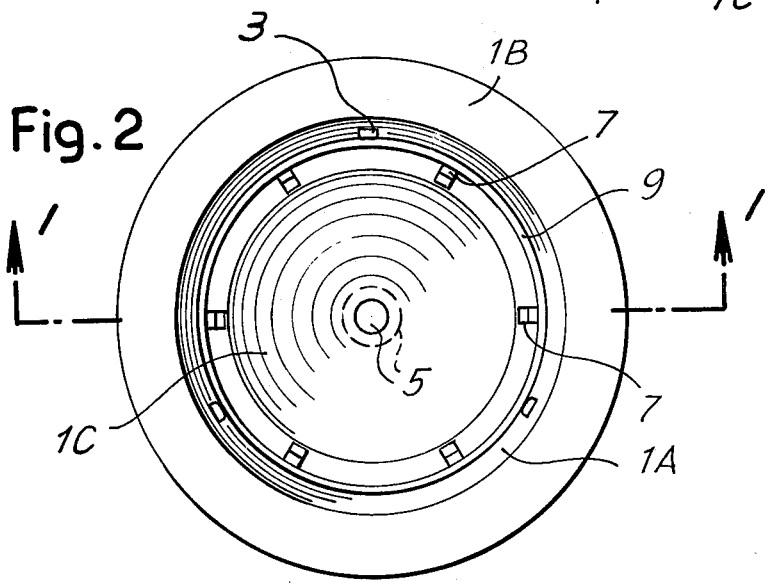
FIG. 2 is a plan view along II—II of FIG. 1.

According to what is shown in the accompanying drawing, 1 denotes a glass-shaped body made up in a thermoplastic material by injection moulding; said glass-shaped member presents a slightly conical wall 1A provided with three light inner ribs 3 which serve for letting a plurality of glass-shaped bodies 1, fitted in one another, rest in one another. The wall 1A in correspondence of the upper major base presents an external flanged projection 1B; in correspondence of the smaller lower base of the wall 1A, the body 1 presents a bottom 1C slightly shaped like a hopper extending with a hollow extension 5 closed at the end in 5A, the end 5A being able of being removed to form thus with the extension 5 a delivery nozzle of the content. In correspondence of the junction between the side wall 1A and the bottom 1C, where the inner ribs 3 are already annulled, there are provided several extensions 7 angularly spaced from one another and each made with a square profile. Above said extensions 7 (which may be in a number of six as shown in the drawing), there is provided a light continuous inner projection 9.

Into the glass-shaped body 1, before the introduction of the concentrated unitary dose, a laminar disc 10 of a limitedly flexible thermoplastic material is introduced whose peripheral edge 10A (FIG. 1) extends with a bevel cut profile, i.e. like an oak beak with an upwardly and outwardly directed tapering. The disc 10, 10A is made up — in size and strength — in such a manner that it rests on the projection 9 with a slight radial forcing against the inner surface of the wall 1A immediately above the projection 9, thus forming a sealing closure bottom which separates the lower portion of the interior of the body 1 from the portion above the projection 9 wherein the unitary dose for making the beverage may be contained. A pierceable baffle 12 is applied onto the lip 1B to seal the content.

Figure 4:
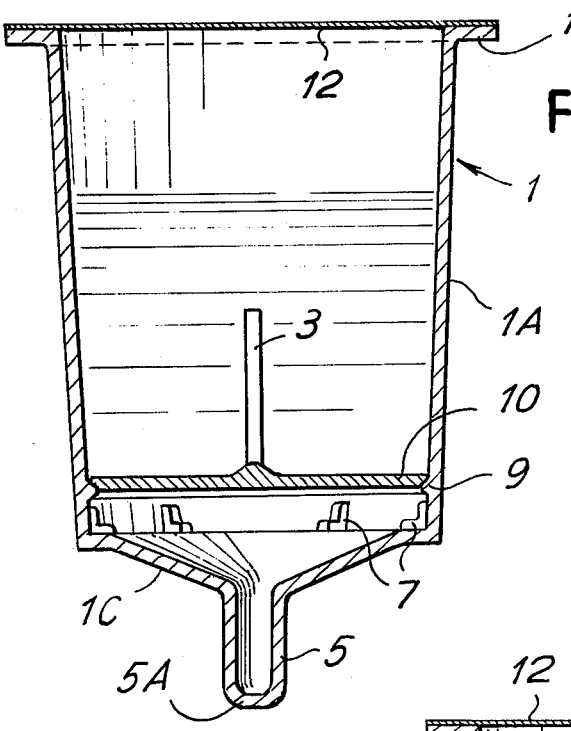
FIG. 4 illustrates the capsule in an axial section under the preservation conditions.
Figure 5:
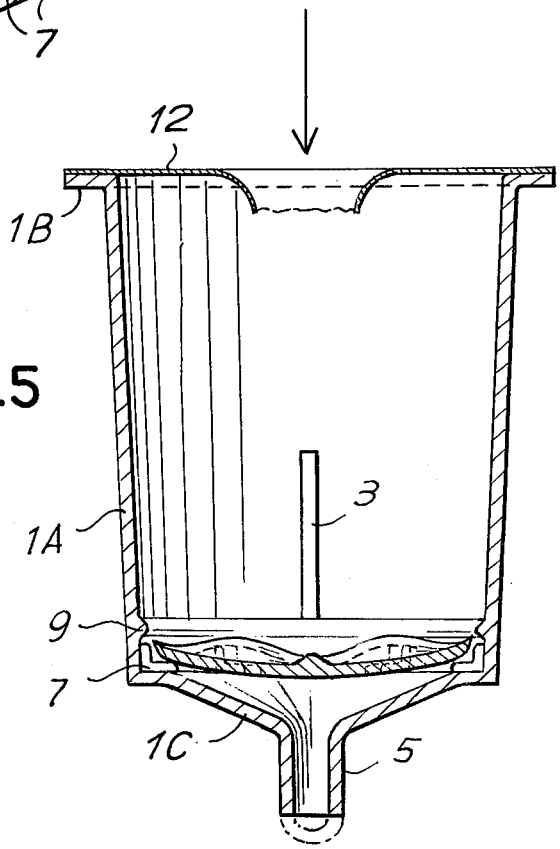
FIG. 5 illustrates the capsule in the arrangement wherein the mixture is effected and the delivery is going to take place, still in an axial section.
Figure 6:
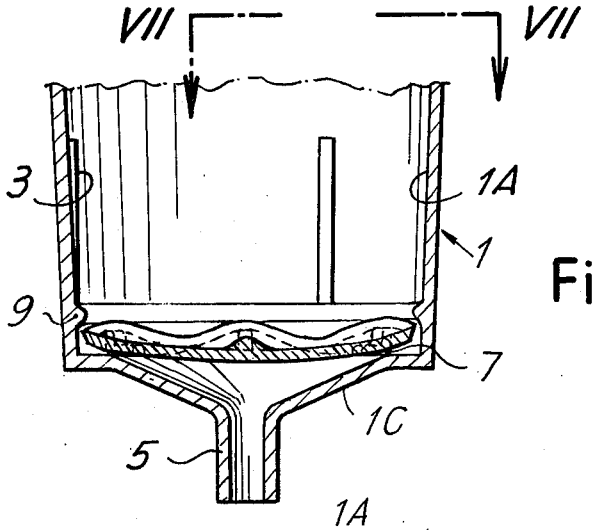
FIG. 6 illustrates a local section in a different position with respect to that of FIG. 5.
Figure 7:
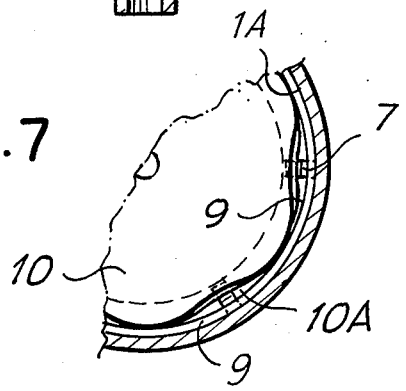
FIG. 7 illustrates a local section along VII—VII of FIG. 6.
Figure 8:
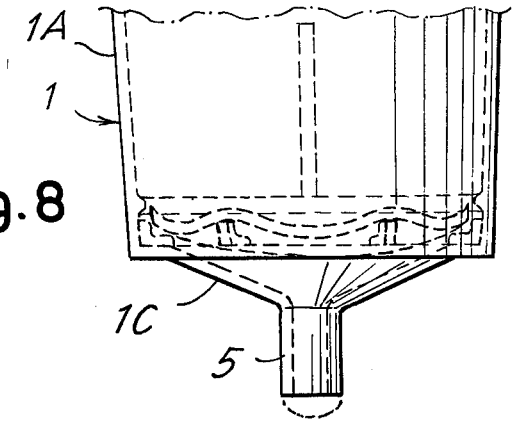
FIG. 8 illustrates a partial external view.

The capsule for the preservation and distribution thus appears as shown in FIG. 4.

When one has to proceed to the delivery of the unitary dose, with the aid of a pressurized fluid which is introduced through a perforation in the baffle 12 within the interior of the capsule (according to a mode and criteria known per se), one initially proceeds to cut off the extension 5 to remove its end 5A and then starts the delivery of the fluid under pressure, which may be a diluent, for instance water or the like, unless the capsule content is already prepared for administering it, in which case the pressurized fluid is only a gaseous fluid; the fluid may also be a gassed liquid, or it may be provided to introduce a diluting liquid, e.g. in order to dissolve the dry contents of the capsule or to dilute the highly concentrated contents thereof, while proceeding as a last step to introduce a diluting liquid and/or a pressurized gas for the ejection and thus the delivery through the nozzle formed by the extension 5.

In any case, when a certain inner pressure is reached within the capsule, the disc 10 under the thrust of the pressure downwardly exceeds the continuous supporting edge 9 and rests at discontinuous points on the aforesaid extensions 7. Still by effect of the pressure, the disc edge is deformed with a certain corrugation as it is approximately shown in FIGS. 5 to 8 and the same disc becomes slightly convex. This is sufficient to determine a separation of the edge 10A of the disc from the wall 1A and to exclude the sealing effect previously afforded by the disc 10; the liquid contained in the capsule may thus flow out from the nozzle formed by the extension 5; the outflow takes place with regularity even in the presence of a high pressure in the capsule interior, owing to the high strength afforded by the passages of a relatively very small section which are formed by the wall 1A and by the edge 10A which has been deformed as above stated.

The capsule thus obtained is unexpensive, offers a positive operation in connection with all the necessary requirements and is adapted to deliver any type of unitary dose with which a beverage may be extemporarily prepared, whereby said dose may be liquid (for instance a syrup), granulated, powdered, liophilized or set up in any other manner.

It is intended that the drawing illustrates an embodiment given only as a practical demonstration of the invention, said invention being in conditions as to be varied in the forms and arrangements without however departing from the scope of the concept which informs the same invention.

What I claim is:

1. A capsule confection for concentrated products to deliver them under the effect of a pressurized fluid which is introduced into the capsule confection for selectable forming and delivery of a beverage from said confection, said capsule comprising: a glass-shaped body with a tapered bottom, a terminal central hollow extension capable of being cut off, a conical side wall, a continuous supporting edge inside of said wall, and supporting extensions below said edge; a closure pierceable baffle for introducing the diluent; a relatively flexible seal disc which is introduced into the glass-shaped body to rest along said continuous supporting edge ensuring the seal with a slight forcing between the disc periphery and the lateral wall of the capsule; said inner extensions below said supporting edge being adapted to contact said sealing disc when the latter is urged by an internal pressure beyond said supporting edge, in such a manner that said disc by effect of the internal pressure is deformed along the periphery allowing the outflow of the liquid from the interior of the glass-shaped body through the hollow cut-off extension forming a delivery opening.

2. A confection as in claim 1, wherein said internal extensions, designed to support the disc edge in a discontinuous manner, are shaped like square scarp buttresses, to facilitate the support of the edge and the deformation of the disc in the centripetal direction under the effect of the internal pressure.

3. A confection as in claim 1, wherein said continuous supporting edge formed by said side wall is made up by a slight annular projection on the inner suface of the glass lateral wall.

4. A confection as in claim 1, wherein said disc is shaped peripherally with a slightly chamfered profile.

* * * * *